United States Patent [19]

Heidrich

[11] 4,018,152

[45] Apr. 19, 1977

[54] APPARATUS FOR APPLYING INDICA ON PHOTOGRAPHIC PAPER OR THE LIKE

[75] Inventor: Günter Heidrich, Munich, Germany

[73] Assignee: AGFA-Gevaert, A.G., Leverkusen, Germany

[22] Filed: Sept. 18, 1975

[21] Appl. No.: 614,634

[30] Foreign Application Priority Data

Sept. 21, 1974 Germany ..... 2445279

[52] U.S. Cl. ..... 101/45; 101/41; 101/110; 101/292; 101/316; 101/93.48; 197/53

[51] Int. Cl.[2] ..... B41J 3/54; B41J 7/48; B41J 29/38

[58] Field of Search ..... 100/265, 266; 83/588, 83/615–617; 197/49–55; 101/93.48, 57, 4, 41, 45, 287, 288, 292, 316, 110

[56] References Cited

UNITED STATES PATENTS

| | | | |
|---|---|---|---|
| 611,926 | 10/1898 | Murray | 101/110 |
| 1,379,118 | 5/1921 | Marsa | 100/265 |
| 2,757,605 | 8/1956 | Dumey | 101/93.01 |
| 2,813,481 | 11/1957 | Hansen | 101/287 |
| 2,913,978 | 11/1959 | Lane | 101/4 |
| 3,094,922 | 6/1963 | Crane | 101/44 |
| 3,165,988 | 1/1965 | Wick et al. | 354/100 |
| 3,168,863 | 2/1965 | McRae | 101/DIG. 3 |
| 3,174,426 | 3/1965 | Boekeloo et al. | 101/42 |
| 3,490,365 | 1/1970 | Roche | 101/292 |
| 3,807,301 | 4/1974 | Decker | 197/49 |
| 3,832,946 | 9/1974 | Lupkas et al. | 101/93.08 |
| 3,902,419 | 9/1975 | Pflugbeil et al. | 101/291 |
| 3,905,258 | 9/1975 | Nagy et al. | 83/616 |

*Primary Examiner*—Edgar S. Burr
*Assistant Examiner*—William Pieprz
*Attorney, Agent, or Firm*—Michael J. Striker

[57] ABSTRACT

Apparatus for applying printed matter to the rear sides of webs of photographic paper in a copying machine has an upright frame for a vertically reciprocable housing which is lifted by a first rotary electromagnet and retained in raised position and thereupon released by a second rotary electromagnet. The housing is movable up and down with several modules each of which contains a wheel having at its periphery a set of symbols. Selected symbols can be moved to positions at the lowermost points of the respective wheels by remotely controlled electromagnets so that such selected symbols face a ribbon which is located above the rear side of a web of photographic paper. The modules are movable downwardly in the housing against the opposition of separate springs and the frame carries a projection which intercepts the housing, after the housing is released by the second electromagnet and while the housing descends by gravity, before the selected symbols can press the ribbon against the web of photographic paper. When the housing is intercepted, the modules therein descend due to inertia and against the opposition of the respective springs whereby the selected symbols press the adjacent portions of the ribbon against the rear side of the web. The housing is lifted by the first electromagnet in automatic response to completion of an exposure in the copying machine.

17 Claims, 4 Drawing Figures

APPARATUS FOR APPLYING INDICA ON PHOTOGRAPHIC PAPER OR THE LIKE

BACKGROUND OF THE INVENTION

The present invention relates to apparatus for encoding information on webs or strips, especially on webs or strips having layers consisting of photosensitive material, and more particularly to improvements in apparatus for applying printed matter to webs or strips which are moved stepwise through a photographic copying machine. Still more particularly, the invention relates to improvements in apparatus for applying printed matter to the rear sides of successive frames of a web or strip of photographic paper.

The commonly owned U.S. Pat. No. 3,165,988 to Wick et al. discloses an apparatus wherein wheel-shaped holders of symbols are mounted on the continuously driven shaft of a transmission and each holder receives torque from the shaft through the medium of a discrete friction clutch. When a selected symbol on a given holder is moved adjacent to a ribbon which is placed between the holders and the rear side of a web of photographic paper, a pawl engages and arrests the corresponding holder. Once the selected symbols of all holders are adjacent to the web, the latter is pushed against the ribbon by a pressure plate so that the selected symbols transfer ink from the ribbon onto the rear side of the web. Selected symbols are moved adjacent to the ribbon in response to depression of corresponding keys on a keyboard. The symbols can represent the extent to which the photosensitive layer of the web of printing paper is exposed to light of a given color or other data which should be recorded or encoded prior, during or subsequent to reproduction of the image of an original.

A drawback of the just outlined apparatus is that it is prone to malfunction, especially in view of the fact that it employs several friction clutches. Moreover, and since all of the clutches are continuously driven by the output shaft of the transmission, the wear upon the clutches is extensive and the inspection, repair and/or replacement of parts invariably entails length interruptions in operation of the copying machine.

SUMMARY OF THE INVENTION

An object of the invention is to provide a novel and improved apparatus for applying indicia, such as letters and/or numerals, to carriers of information, especially for applying indicia to the rear side of a web of photographic paper the front side of which is coated with a photosensitive emulsion.

Another object of the invention is to provide an apparatus which can apply indicia at frequent intervals, which can be used with advantage in existing photographic or other types of copying machines, and which can utilize commercially available modules with sets of appropriate symbols.

A further object of the invention is to provide an apparatus which can be rapidly converted for the application of different types of indicia, whose energy requirements are surprisingly low, and which can apply indicia to photographic paper prior to exposure of photosensitive material to light without risking pressure-induced exposures at the locations where the indicia are applied to the paper.

An additional object of the invention is to provide novel and improved means for facilitating proper retention of prefabricated modules in and convenient removal and reinsertion of such modules to optimum positions with respect to a carrier of information.

Still another object of the invention is to provide an apparatus wherein the intensity of impressions or imprints on the carrier can be regulated within a desired range and wherein the intensity of each of a series of simultaneously applied indicia can be regulated independently of the others.

The invention is embodied in an apparatus for applying indicia to carriers of information, particularly for applying colored matter to rear sides of webs or strips of the type having a layer of photosensitive material at the front side thereof. Such webs or carriers may consist of printing paper of the type used in photographic copying machines to make prints of the images of film frames. The apparatus comprises a frame which can be detachably or permanently secured to a photographic copying machine, a housing which is mounted in and is movable up and down relative to the frame, a rotary electromagnet or analogous means for moving the housing to a raised position so that, when the housing is thereupon released (e.g., in response to short-lasting energization of a second electromagnet), it automatically descends in the frame by gravity, a channel or an analogous support for information carriers (such channel is mounted in the frame or on the copying machine below the housing), a ribbon or an analogous deformable source of coloring matter intermediate the housing and the support, and a plurality of modules (e.g., so called pressure decades) which are vertically movably mounted in the housing. Each module has a wheel or an analogous holder for a plurality of symbols (such symbols may represent numerals, letters and/or other indicia), and each module further comprises an electromagnet or other suitable means for indexing the respective holder to move a selected symbol opposite the ribbon. The apparatus further comprises biasing means for yieldably opposing downward movement of modules relative to the housing, and means for intercepting the descending housing in a second position in which the selected symbols are at least slightly spaced apart from the carrier on the support so that the carrier is still out of contact with the ribbon. When the descending housing is intercepted, the modules begin to descend by inertia so that they move downwardly relative to the housing and against the opposition of the biasing means whereby the selected symbols press the adjacent portions of the ribbon against the carrier on the support and the ribbon applies to the carrier indicia constituting replicas or reproductions of the selected symbols.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments wieh reference to the accompanying drawing.

DESCRIPTION OF THE PREFERRED EMBODIMENTS

Figure 1:
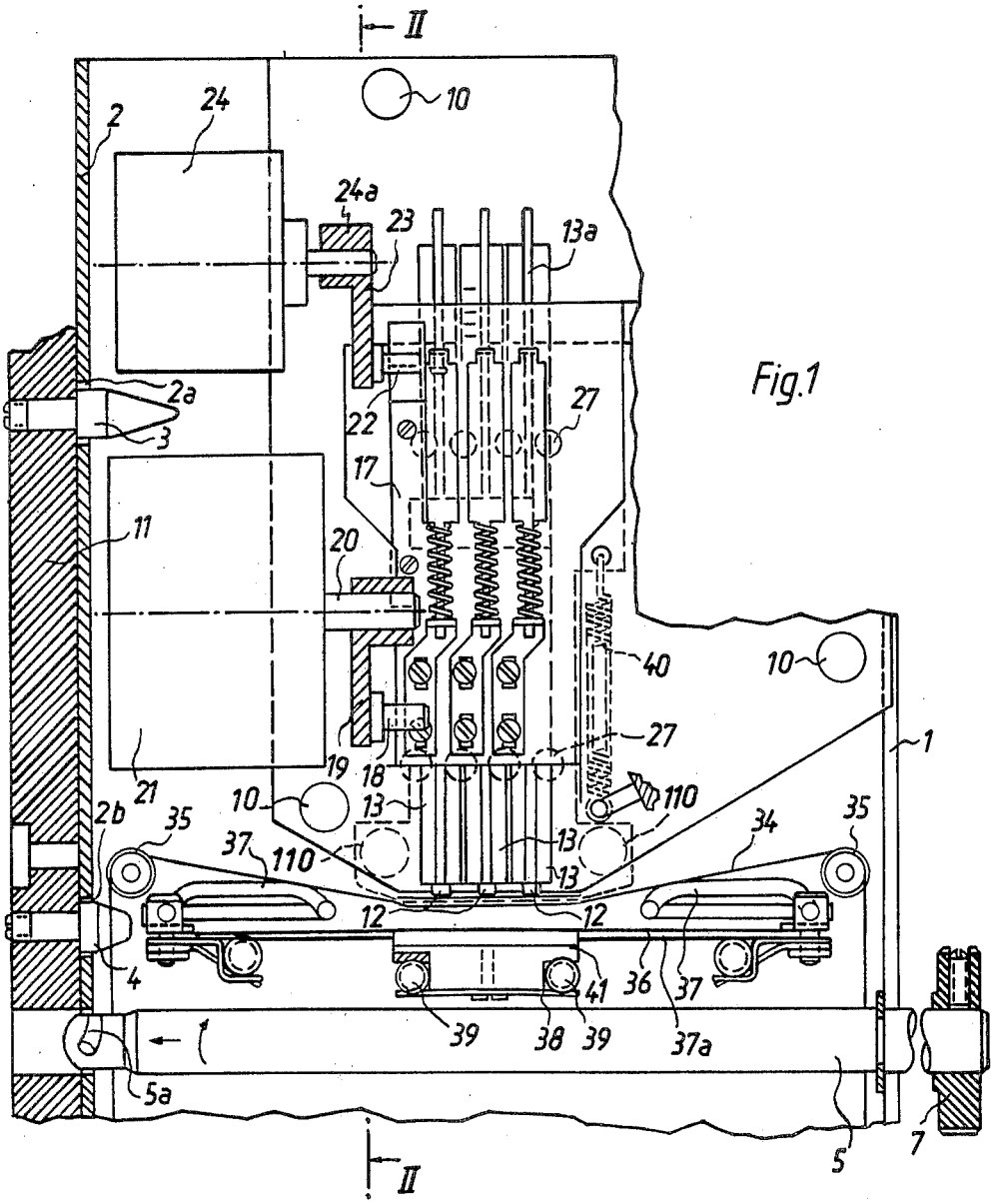
FIG. 1 is a fragmentary transverse vertical sectional view of an apparatus which embodies the invention, the section being taken in the direction of arrows as seen from the line I—I of FIG. 2.

The apparatus of FIGS. 1 to 4 comprises a substantially cubical frame including four upright walls 1, 2, 8 and 9. The width of the walls 8, 9 exceeds the width of the walls 1, 2 (compare FIGS. 1 and 2) and the walls 8, 9 are secured to the respective end portions of horizontal distancing bolts 10. The marginal portions of the walls 1 and 2 are welded or otherwise fixedly secured to the adjoining marginal portions of the walls 8 and 9. The wall 1 is assumed to be the front wall of the frame; the wall 2 is the rear wall and the walls 8, 9 constitute the side walls. The rear wall 2 has holes 2*a*, 2*b* which receive cylindrical portions of generally conical supporting studs 3, 4 extending forwardly from the front plate 11 of the casing of a copying machine. The walls 1 and 2 further support a horizontal locking shaft 5 which can be rotated by a wheel or knob 7 located in front of the wall 1. The rear end portion of the shaft 5 carries a hooked male coupling member 5a which can engage a complementary female coupling member (e.g., a springy yoke) on the plate 11 when the wheel 7 is rotated in one direction. When the wheel 7 is rotated in the opposite direction to disengage the male coupling member 5a from the complementary female coupling member, the frame can be detached from the casing of the copying machine by sliding the holes 2*a*, 2*b* off the respective studs 3 and 4. The rear wall 2 of the frame further carries a suitable plug (not shown) with a plurality of prongs which can be inserted into a complementary socket of the plate 11 to establish an electrical connection between the copying machine and the components in the interior of the frame.

The side walls 8 and 9 are respectively formed with pairs of vertical slots 8*a*, 8*b* and 9*a*, 9*b* (FIG. 2) for sleeves 42 which surround pin-shaped followers 16 secured to a vertically reciprocable housing in the interior of the frame. The sleeves 42 may consist of sintered bronze or an analogous material. The housing includes two spaced-apart parallel vertical panels or platens 14, 15 which are respectively adjacent to the inner sides of the side walls 8 and 9. The panels 14, 15 are fixedly secured to distancing bolts 110, and the followers 16 are riveted or otherwise secured to and extend from the outer sides of the panels. The housing including the panels 14, 15 receives a set of flat casette-like modules or magazines 13 each of which contains a wheel- or disk-shaped indexible holder 113 for markers or symbols 12. Such symbols may represent the numerals 0 to 9.

The panel 14 further supports a block 17 which consists of synthetic plastic material and is formed with two substantially horizontal shoulders 17*a*, 17*b* facing downwardly toward the shaft 5. The block 17 is secured to the panel 14 by means of screws or other suitable fasteners. The shoulder 17*b* is located at a level above the shoulder 17*a* and is nearer to the wall 9. The lower shoulder 17*a* can serve as an abutment for a pin 18 at the outer end of a lever 19 which is rigid with the horizontal shaft 20 of a rotary electromagnet 21 secured to at least one wall of the frame. When the electromagnet 21 is energized to rotate the shaft 20 in counterclockwise direction, as viewed in FIG. 2, the entire housing is moved upwardly whereby the sleeves 42 for the followers 16 slide in the respective slots 8*a*, 8*b*, 9*a*, 9*b*. The thus lifted housing including the panels 14, 15 can be retained in the raised position by a pin 22 on the lower end of a lever 23 which is attached to the shaft 24*a* of a second rotary electromagnet 24 secured to the frame. When the retaining electromagnet 24 is deenergized, a suitable spring (not specifically shown) tends to pivot the lever 23 in a counterclockwise direction, as viewed in FIG. 2, so that the pin 22 moves below the shoulder 17*b* and retains the housing in the raised position even if the electromagnet 21 is thereupon deenergized so that a suitable return spring (not shown) pivots the lever 19 clockwise and thereby moves the pin 18 away from the lower shoulder 17*a*. The just described mode of lifting the housing and of thereupon retaining the housing in the raised position exhibits the advantage that the energy requirements of the electromagnets 21, 24 are minimal, i.e., the electromagnet 21 is energized only during the short interval which is required to lift the housing to raised position and the electromagnet 24 is energized only during the short interval which is necessary to disengage the pin 22 from the shoulder 17*b* so that the housing and the modules 13 therein can descend by gravity.

The side wall 8 carries an intercepting projection 26 the upper side of which is connected with a layer or cushion 26*a* of shock-absorbent elastomeric plastic material. The cushion 26*a* is located in the path of downward movement of a projection 25 which is secured to the outer side (and is preferably adjacent to one vertical marginal portion) of the panel 14. The intercepting projection 26 is preferably adjustable relative to the wall 8 (see the double-headed arrow 26A) so that the attendant can select that distance which the housing in the frame must cover (upon energization of electromagnet 24 and resulting disengagement of the pin 22 from the shoulder 17*b*) before underside of the projection 25 reaches the cushion 26*a*. The position of the intercepting projection 26 is preferably selected in such a way that, when the projection 25 rests on the cushion 26*a*, the symbols 12 are sufficiently remote from the plane of a web 36 of photographic paper to allow for convenient and rapid threading of the web through the apparatus.

The modules 13 are preferably of the type known as "Druckdekaden" (pressure decades) produced by Hengstler of Heiligenhaus, Federal Republic of Germany. Suitable modules are described and shown on pages 1 to 8 of the pamphlet No. 885 3000 entitled "Hengstler Drucksysteme Heiligenhaus, Druckdekaden System 883" published by Hengstler in March of 1973. Such electromechanical modules employ electromagnets which drive pawls for the indexible holders 113 which preferably consist of synthetic plastic material and whose peripheries are provided with symbols corresponding to those shown at 12 in FIG. 1 of the drawing. The modules 13 have casings in the form of flat casettes which are reciprocably mounted in the housing including the panels 14 and 15. The selected symbols 12 extend outwardly through cutouts or windows in the lower end portions of the respective cassettes. The electromagnets of the modules 13 receive impulses by way of the aforementioned plug which is mounted on the rear wall 2 and extends into a complementary socket of the copying machine including the plate 11.

Figure 2:
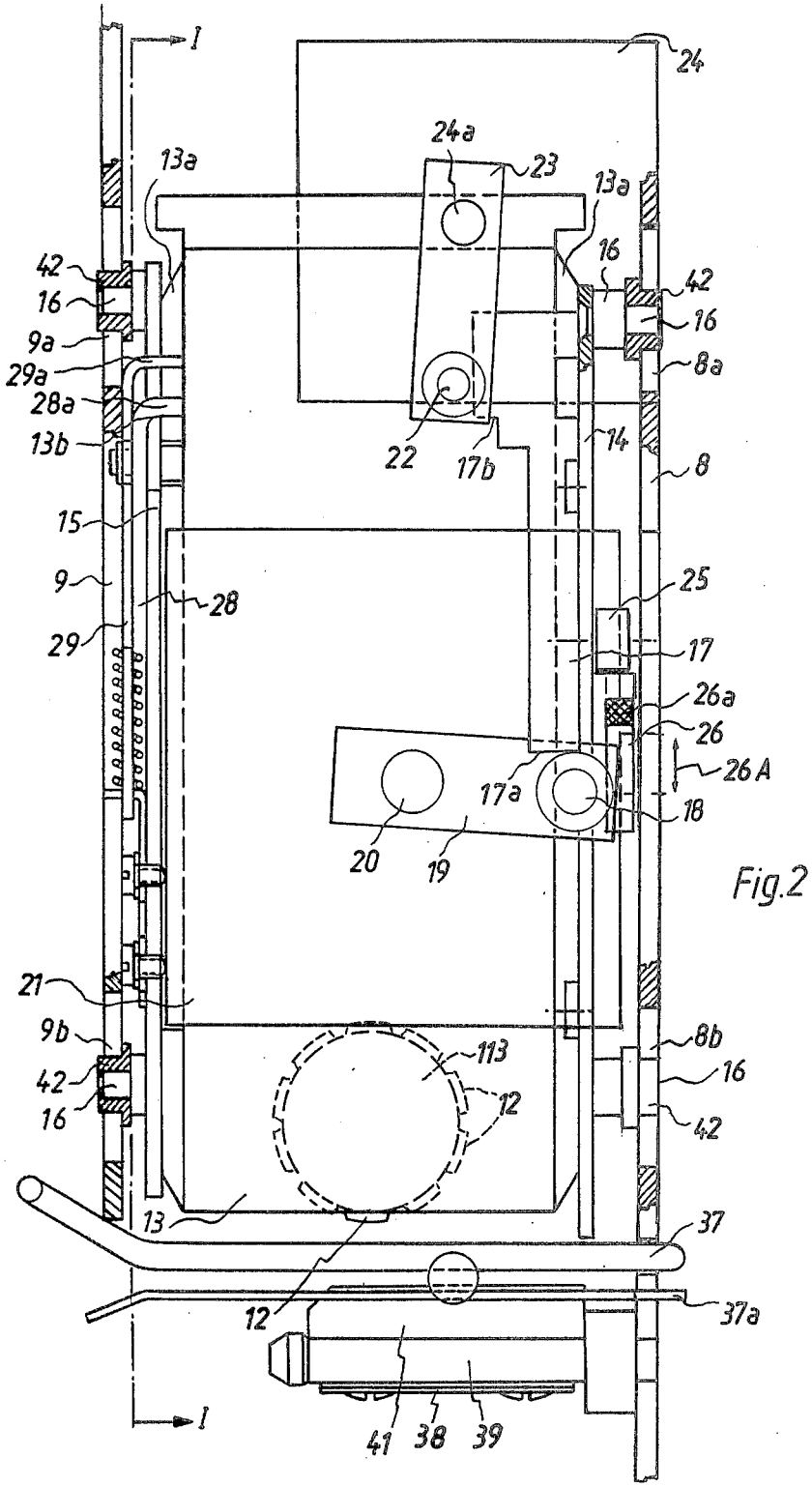
FIG. 2 is an enlarged longitudinal vertical sectional view, substantially as seen in the direction of arrows from the line II—II of FIG. 1.

The narrow vertical edge portions of cassettes forming part of the modules 13 have vertically extending elongated ribs or extensions 13*a* which are closely adjacent to the inner sides of the panels 14 and 15 (see FIG. 2). The inner sides of the panels 14, 15 carry cylindrical guide posts 27 which define relatively narrow passages for the adjacent ribs 13a and thus prevent excessive lateral movements of the modules 13 (in directions to the right or to the left, as viewed in FIG. 1). The posts 27 allow the modules 13 to move up or down with respect to the panels 14 and 15.

Those ribs 13*a* of the modules 13 which are adjacent the panel 15 have notches or grooves 13*b* (see particularly FIG. 2) which receive suitably bent stops 28*a* and 29*a* serving to limit the extent of vertical movement of modules 13 with respect to the housing. A discrete stop 28*a* and a discrete stop 29*a* is provided for each of the modules 13. All of the stops 28*a* are integral with a transversely extending strip-shaped vertical slide 28 having two aligned horizontal slots 28*b* (FIG. 3) for clamping screws 30 secured to the housing. When the screws 30 are loosened, the slide 28 can be shifted in the longitudinal direction of the slots 28*b*. The stops 28*a* of the slide 28 limit the extent of upward movement of the respective modules 13, i.e., they prevent the modules from moving upwardly beyond the positions corresponding to that of the module shown in FIG. 2.

The slide 28 supports a set of aligned horizontal guide pins 31 which are riveted or otherwise affixed thereto and serve to guide discrete elongated vertical slides 29, one for each of the modules 13 and each comprising one of the stops 29*a*. The pins 31 extend through vertical slots 29*b* of the respective slides 29. The slides 29 are held against movement axially of the respective guide pins 31 (i.e., toward or away from the plane of the horizontal slide 28) by means of split rings 31*a* or the like. Each vertical slide 29 includes a relatively narrow (preferably rodlike) lower portion 29*c* which is surrounded by a resilient element here shown as a helical spring 32. The lowermost convolutions of the springs 32 bear against retainers here shown as platforms 33*a* provided at the upper ends of discrete brackets or supports 33 which are bolted, screwed or otherwise affixed to the housing (e.g., to the panel 16, see FIGS. 3–4). The platforms 33*a* have holes to allow for reciprocation and some tilting of the respective lower portions 29*c*. Each of the brackets 33 may consist of sheet metal and is preferably adjustably secured to the panel 15 so as to allow for changes in the bias of the respective springs 32 (see the screws 133).

Figure 4:
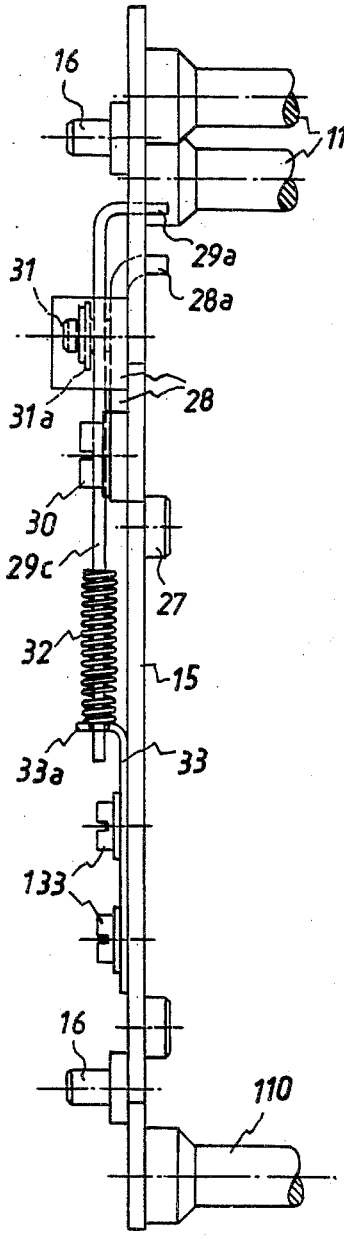
FIG. 4 is a view as seen from the right-hand side of FIG. 3.
Figure 3:
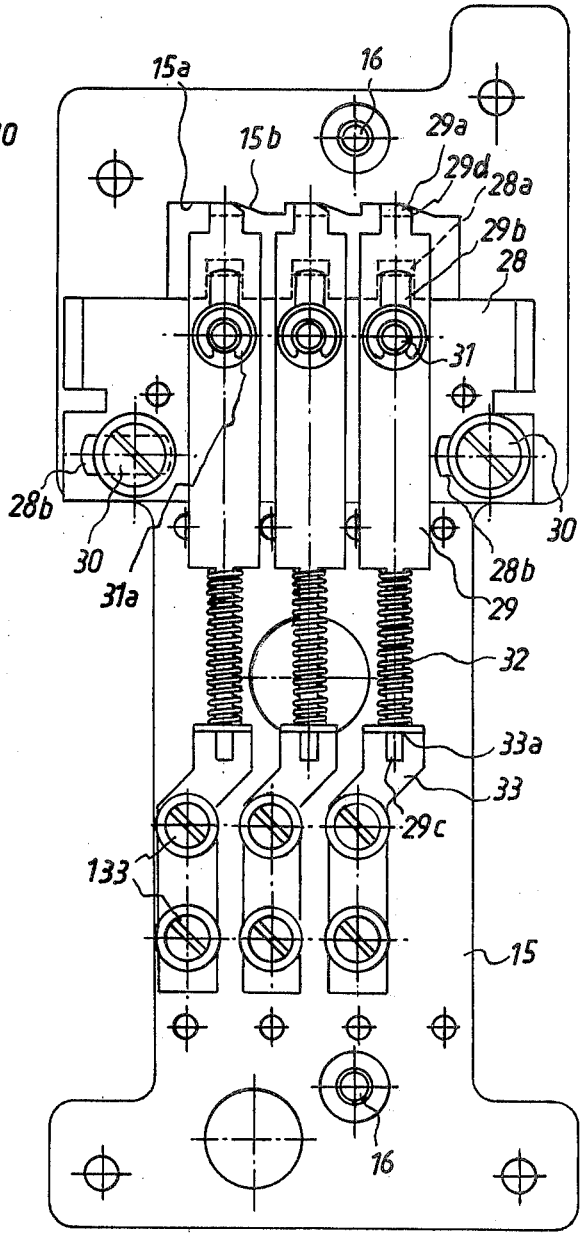
FIG. 3 is an enlarged view of a detail in FIG. 1.

As shown in FIGS. 3 and 4, the slides 28 and 29 are adjacent to the outer side of the panel 15; therefore the latter is formed with a large opening or cutout 15*a* (FIG. 3) the upper side of which is bounded by an edge face including several sloping portions or cam faces 15*b*, one for each of the slides 29. The stops 28*a* and 29*a* extend through the opening 15*a* and into the space between the panels 14 and 15. When the slide 28 assumes the normal position shown in FIG. 3 (shanks of the clamping screws 30 are then located in the right-hand portions of the respective slots 28*b*), the stops 29*a* of the vertical slides 29 abut against the panel 15 in regions adjacent to and at a level above the respective cam faces 15*b*. The right-hand sides of the stops 29*a* (as viewed in FIG. 3) are rounded or chamfered, as at 29*d*, so as to insure that the stops 29*a* will readily slide along the adjacent cam faces 15*a* when the clamping screws 30 are loosened and the slide 28 is shifted in a direction to the right. This moves the stops 28*a*, 29*a* out of the notches 13*b* of the ribs 13*a* on the cassettes of the respective modules 13 so that the modules can be withdrawn by moving them upwardly, as viewed in FIG. 1. When the operator has inserted a fresh set of modules 13, or when the attendant has inspected or replaced one or two modules (the housing is assumed to be capable of receiving a maximum of three modules), the slide 28 is moved back to the position of FIG. 3 whereby the stops 29*a* slide along the adjacent cam faces 15*b* (under the action of the respective springs 32 and while the lower portions 29*c* pivot with respect to the associated retainers 33*a*) and come to rest in the positions shown in FIG. 3 in which they extend into the notches 13*b* of the adjacent modules 13 and thus prevent removal of such modules from the housing. The stops 28*a* share the movements of the stops 29*a* since they are rigid with the slide 28. If desired, the arrangement shown in FIG. 3 may be such that the attendant must depress the vertical slides 29 against the opposition of the springs 32 before the slide 28 is returned to the position of FIG. 3; this insures that the stops 29 enter the respective notches 13*b*.

A deformable source of coloring matter, e.g., a ribbon 34, is trained over guide rollers 35 (see FIG. 1) so that it extends between the exposed (selected) symbols 12 and the web 36 of photographic paper. The ribbon 34 is paid out by a customary supply reel and is collected by a takeup reel (both not shown) in a manner analogous to that known from the art of office machines. The mechanism for transporting the ribbon 34 lengthwise is not shown; such mechanism may be analogous to that used in typewriters. The web 36 is held down by pivotable yokes 37 which further serve to facilitate the threading of the leader of a fresh web through the apparatus. That portion of the web 36 which is to receive impressions in response to downward movement of modules 13 relative to the housing is located above an anvil 41. The latter has cutouts which are machined into its underside and receive portions of supporting rods 39 which are mounted in the frame. The underside of the anvil 39 is further connected with a leaf spring 38 which overlies the rods 39 from below. The upper side of the anvil 41 preferably carries a layer of elastomeric plastic material, such as "Vulcollan" (trademark). The web 36 is supported by and guided in a supporting channel 37*a* made of sheet metal and carrying the yokes 37. This channel is preferably detachable from the frame, the same as the anvil 41, so that each of these parts can be readily removed for inspection, cleaning or replacement. The quick-release means which secure the anvil 41 and channel 37*a* in requisite positions are not shown in the drawing. The channel 37*a* can also be removed in order to afford access to the ribbon 34, e.g., to allow for convenient threading of a fresh ribbon through the apparatus.

The operation is as follows:

The web 36 is moved to requisite position in which the rear side of one of its frames is ready to receive impressions in response to impingement of selected symbols 12 against the upper side of the ribbon 34. The placing of selected symbols 12 into positions corresponding to those of the symbols shown in FIG. 1 (i.e., opposite the ribbon 34) is effected in response to transmission of electric signals to the respective modules 13 in a manner not forming part of the invention, for example, in a manner analogous to that disclosed in the aforementioned U.S. Pat. No. 3,165,988. If the number of positions which the holder 113 in a module 13 can assume is greater than the required number of different symbols 12, one and the same holder 113 can carry two sets of identical symbols 12 (e.g., numerals 1 to 5) whereby the identical symbols are angularly offset with respect to each other by 180°. This renders it possible to reduce the length of intervals which are needed to place selected symbols next to the upper side of the ribbon 34. Such situation can arise when the originals are very thin so that the length of intervals during which the originals are exposed to printing light is very short. In such instances, the interval which is required for placing a selected symbol next to the ribbon 34 could be longer than the exposure time. In other words, the modules 13 can be designed with a view to insure that the output of the copying machine will not be affected by the length of intervals which are needed for selection of appropriate symbols. Moreover, by utilizing wheel-shaped holders for several sets of identical symbols, the extent to which the holders must be indexed (normally rotated) by respective electromagnets for selection of appropriate symbols can be reduced with attendant reduction in wear upon the moving parts.

When all of the selected symbols 12 are adjacent to the upper side of the ribbon 34, the apparatus receives a signal to effect the application of indicia to the upper side of the web 36. The rotary electromagnet 21 has been energized for a short interval in automatic response to completion of the preceding printing operation so that the pin 18 has lifted the housing 14, 15 above the position shown in FIG. 2. Therefore, the pin 22 was moved below the shoulder **17*b* prior to denenergization of the electromagnet 21. Consequently, the housing dwells in the raised position because the aforementioned spring maintains the pin 22 in engagement with the shoulder 17*b*. The transmission of aforementioned signal results in short-lasting energization of the electromagnet 24 which disengages the pin 22 from the shoulder 17*b* so that the housing (with the modules 13 therein) can descend by gravity (the electromagnet 21 is deenergized so that the pin 18 cannot interfere with downward movement of the housing). The downward movement of the housing can be assisted by a helical spring 40 (FIG. 1) or by analogous biasing means. The housing is intercepted by the projection 25 before the selected symbols 12 can move the ribbon 24 into contact with the upper side of the web 36 in the channel 37a. However, the stop 25 arrests only the housing including the panels 14, 15; the inertia of relatively heavy modules 13 causes the latter to move downwardly with respect to the intercepted housing (whereby the vertical slides 29 move relative to the guide pins 27 and retainers 33*a*). The descending modules 13 cause the respective selected symbols 12 to press the adjacent portions of the ribbon 34 against the upper side of the web 36 whereby the ribbon applies information before the springs 32 are free to expand and to lift the selected symbols 12 above and away from the ribbon 34. Once the modules 13 are lifted by the respective springs, the electromagnet 21 is energized for a short interval of time to lift the housing 14, 15 so that the pin 22 can reengage the shoulder 17*b* and thereby holds the housing in the raised position. The same procedure is repeated again, but normally with a different set of selected symbols 12, when the next frame of the web 36 is properly located below the modules 13**.

An important advantage of the feature that the application of indicia to the web 36 takes place in response to gravitational descent of the modules 13 (first together with and thereupon relative to the housing 14–15) is that friction can be reduced to a minimum and cannot appreciably influence the application of indicia to the web portion above the anvil 41. Moreover, the useful life of electromagnets 21 and 24 is surprisingly long because each of these electromagnets must be energized only once and for a very short interval during each printing operation. Thus, the electromagnets 21, 24 are not heated (heating invariably causes fatigue) and they need not produce and/or apply substantial forces for any extended periods of time. Still further, and since the electromagnets 21, 24 do not promote the movement of modules 13 toward the ribbon 34, the fact that their forces might vary due to fatigue or for other reasons cannot influence the quality of imprints which are being applied to the web 36.

The adjustability of the bias of springs 32 independently of each other (by adjusting the respective brackets 33) enables an attendant to insure that each and every impression is clearly readable (either by naked eye or by a photoelectric scanner) and that all of the impressions are equally pronounced. Such individual adjustability of springs 32 is particularly important when the impressions are to be applied to the rear sides of webs which are about to be exposed to printing light because the operator is in a position to select the magnitude of impacts which the symbols 12 transmit to the web portion on the anvil 41 with a view to prevent pressure-induced exposures of photosensitive material. Moreover, the attendant is in a position to insure that the modules 13 are subjected to negligible wear. The modules receive signals by way of flexible conductor means, not shown. Such modules are reliable, long-lasting and versatile. It is clear that the housing can be designed to receive only two or more than three modules, depending on the nature of indicia which are to be applied to the carrier.

The width of the stops **29*a* and 28*a* (as considered in a direction from the wall 1 toward the wall 2) is less than the distance between the grooves 13*b* of neighboring modules 13 i.e., the combined thickness of a rib 13*b* plus the width of a stop 28*a* or 29*a* is less than the thickness of the cassette of a module 13; this insures that the stops 28*a*, 29*a* can be moved into the spaces between the adjacent ribs 13*a* when the slide 28 is shifted in a direction to the right, as viewed in FIG. 3, and that the stops 28*a*, 29*a* are disengaged from the respective modules (while the stops 29*a* abut against the respective cam faces 15*b* of the panel 15). The properly inserted modules 13 form a stack of neighboring modules and the slide 28 serves as a means for moving the stops 28*a*, 29*a*** transversely of such modules.

Without further analysis, the foregoing will so fully reveal the gist of the present invention that others can, by applying current knowledge readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. Apparatus for applying indicia to carriers of information, particularly for applying colored impressions, to rear sides of webs of the type having a layer of photosensitive material at the front side thereof, comprising a frame; a housing mounted in and movable up and down relative to said frame; means for moving said housing to a raised first position; means for releasing said housing from said first position so that it descends from said first position by gravity; a support for information carriers located below said housing, a deformable source of coloring matter intermediate said housing and said support; a plurality of modules vertically movably mounted in said housing, each of said modules having a holder for a plurality of symbols and each of said holders being indexible to move a selected symbol opposite said source; biasing means for yieldably opposing downward movement of said modules relative to said housing; and means for intercepting the descending housing in a second position in which said selected symbols are at least slightly spaced from the carrier on said support whereby said modules begin to move downwardly by inertia relative to said housing and against the opposition of said biasing means and said selected symbols press said source against the carrier on said support so that the source applies to the carrier indicia constituting reproductions of selected symbols.

2. Apparatus as defined in claim 1, wherein said holders are rotatable in the respective modules and each of said modules further comprises electromagnet means for indexing the respective holder.

3. Apparatus as defined in claim 1, wherein said source is a ribbon.

4. Apparatus as defined in claim 1, wherein said moving means comprises an electromagnet.

5. Apparatus as defined in claim 1, further comprising means for releasably retaining said housing in said raised position.

6. Apparatus as defined in claim 5, wherein said moving means comprises a first electromagnet which is energizable to move said housing to said raised position and said retaining means comprises a second electromagnet which is energizable to release said housing for movement from said raised position.

7. Apparatus as defined in claim 6, in combination with a photographic copying machine having means for moving the carrier on said support stepwise for the carrier to be exposed to printing light during the intervals of idleness thereof, said machine further having means for energizing said first electromagnet upon each exposure of the carrier.

8. Apparatus as defined in claim 1, wherein at least one of said holders has several sets of identical symbols.

9. Apparatus as defined in claim 8, wherein said one holder is rotatable in the respective module and said symbols are disposed at the periphery thereof, said sets including a first set and a second set and the symbols of said first set being angularly offset by 180° with respect to the corresponding symbols of said second set.

10. Apparatus as defined in claim 1, wherein each of said modules has an external groove and said biasing means comprises a stationary discrete stop and a discrete resilient element for each of said modules, said stops extending into the respective grooves, and said resilient elements reacting against said housing and urging the respective stops upwardly against the corresponding modules.

11. Apparatus as defined in claim 10, further comprising means for adjusting the bias of said resilient elements independently of each other.

12. Apparatus as defined in claim 1, further comprising means for biasing said housing to said second position.

13. Apparatus for applying indicia to carriers of information, particularly for applying colored impressions, to rear sides of webs of the type having a layer of photosensitive material at the front side thereof, comprising a frame; a housing mounted in and movable up and down relative to said frame; means for moving said housing to a raised first position; means for releasing said housing from said first position so that it descends from said first position by gravity; a support for information carriers located below said housing; a deformable source of coloring matter intermediate said housing and said support; a plurality of modules vertically movably mounted in said housing, each of said modules having an external groove and a holder for a plurality of symbols and each of said holders being indexible to move a selected symbol opposite said source; biasing means for yieldably opposing downward movement of said modules relative to said housing, said biasing means comprising a stationary discrete stop and a discrete resilient element for each of said modules, said stops extending into the respective grooves, and said resilient elements reacting against said housing and urging the respective stops upwardly against the corresponding modules; means for moving said stops transversely of the respective modules into and out of the associated grooves; and means for intercepting the descending housing in a second position in which said selected symbols are at least slightly spaced from the carrier on said support whereby said modules begin to move downwardly by inertia relative to said housing and against the opposition of said biasing means and said selected symbols press said source against the carrier on said support so that the source applies to the carrier indicia constituting reproductions of selected symbols.

14. Apparatus as defined in claim 13, wherein the width of said stops is less than the distance between the grooves of neighboring modules.

15. Apparatus as defined in claim 14, wherein said means for moving said stops transversely of said modules comprises a first slide which is reciprocable with respect to said housing and said biasing means further comprises substantially vertical slides each of which includes one of said stops, said first slide having guide pins, one for each of said second slides, and said vertical slides having substantially vertical slots for the respective guide pins.

16. Apparatus as defined in claim 13, wherein said housing comprises cams arranged to depress said stops against the opposition of said resilient elements in response to movement of said stops out of the associated grooves.

17. Apparatus as defined in claim 13 wherein said means for moving said stops transversely of said modules comprises additional stops normally extending into said grooves and arranged to limit the extent of upward movement of said modules with respect to said housing.

* * * * *